US008118304B1

(12) United States Patent
Chen et al.

(10) Patent No.: US 8,118,304 B1
(45) Date of Patent: Feb. 21, 2012

(54) STOPPING DEVICE AND MULTI-FUNCTION PERIPHERAL USING THE SAME

(75) Inventors: Chi-Tsung Chen, New Taipei (TW); Po-Chih Chang, New Taipei (TW); Chao-Hsuan Lee, New Taipei (TW)

(73) Assignees: Cal-Comp Electronics & Communications Company Limited, New Taipei (TW); Kinpo Electronics, Inc., New Taipei (TW)

( * ) Notice: Subject to any disclaimer, the term of this patent is extended or adjusted under 35 U.S.C. 154(b) by 0 days.

(21) Appl. No.: 13/018,399

(22) Filed: Jan. 31, 2011

(30) Foreign Application Priority Data

Dec. 14, 2010 (TW) ..... 99143768 A

(51) Int. Cl.
*B65H 7/00* (2006.01)

(52) U.S. Cl. ..... 271/256; 271/245

(58) Field of Classification Search ..... 271/256, 271/245
See application file for complete search history.

(56) References Cited

U.S. PATENT DOCUMENTS

| | | | | |
|---|---|---|---|---|
| 6,547,235 | B2 | 4/2003 | Higaki | |
| 6,991,227 | B2 | 1/2006 | Kim | |
| 7,571,905 | B2 * | 8/2009 | Kim | 271/117 |
| 2001/0040338 | A1 * | 11/2001 | Kuo et al. | 271/245 |
| 2002/0158407 | A1 * | 10/2002 | Hsiao et al. | 271/245 |
| 2009/0194937 | A1 | 8/2009 | Lee et al. | |
| 2010/0295234 | A1 | 11/2010 | Liu | |

FOREIGN PATENT DOCUMENTS

TW 200911671 3/2009

* cited by examiner

*Primary Examiner* — David H Bollinger
(74) *Attorney, Agent, or Firm* — Jianq Chyun IP Office

(57) ABSTRACT

A stopping device and a multi-function peripheral (MFP) using the same are provided. The stopping device disposed in a track having a recess includes a driving unit, a forcing unit, a first restricting point, a second restricting point, a rotating unit, and a stopping unit. The forcing unit has a pivoting portion pivoted with the driving unit and a forcing portion. The forcing portion is located between the first restricting point and the second restricting point aligned in a perpendicular direction. The rotating unit has a rotating axle, and a first end and a second end located at two opposite sides of the rotating axle. The forcing portion of the forcing unit contacts the first end. The stopping unit has a third end and a fourth end. The third end has an opening, through which the second end of the rotating unit passes.

8 Claims, 4 Drawing Sheets

STOPPING DEVICE AND MULTI-FUNCTION PERIPHERAL USING THE SAME

CROSS-REFERENCE TO RELATED APPLICATION

This application claims the priority benefit of Taiwan application serial no. 99143768, filed on Dec. 14, 2010. The entirety of the above-mentioned patent application is hereby incorporated by reference herein and made a part of this specification.

BACKGROUND OF THE INVENTION

1. Field of the Invention

The present invention generally relates to a stopping device, and in particular, to a stopping device capable of keeping an object intact and a multi-function peripheral (MFP) using the same.

2. Description of Related Art

With the advent of information society, an office may be provided with office automation equipments such as a scanner, a photocopier, and a printer. A user may perform word processing by the aid of the office automation equipment. It should be noted that, when the office automation equipments are configured in an office at the same time, a lot of space is occupied. Therefore, an MFP integrated with, for example, photocopying, printing, and scanning functions, is developed to solve the above problem.

The user usually places a stack of paper in the MFP for use for photocopying, printing, or scanning. The MFP needs a stopping device, so as to precisely stop the paper before the paper is fed into the MFP. A conventional stopping device of the MFP uses a gear to drive a rack, so as to move a paper stopping plate up and down to stop or allow the paper to pass through. However, in the method using the rack, space is required to be reserved in the MFP for the movement of the rack in a perpendicular direction, thus causing limitation to design height, and waste of space, thereby the overall volume of the MFP cannot be decreased effectively.

In addition, another conventional stopping device uses a motor, a spring, a paper fetching arm, a stopping arm, and a restricting point, which work in a combined manner to achieve an effect of stopping or allowing the paper to pass through. However, the spring may become fatigued sometime, reverse rotation with wrong step number of the motor may occur sometime, and thus the paper stopping plate and the stopping arm cannot be restored in positions thereof, and the stopping device fails. Alternatively, when a case of the MFP is opened, the paper stopping function is still kept, in this case, if the paper is still under the paper stopping plate, the paper may be torn.

SUMMARY OF THE INVENTION

Accordingly, the present invention is directed to a stopping device capable of keeping a fed object intact.

The present invention is directed to an MFP having an effectively decreased overall volume.

The present invention provides a stopping device, suitable for being disposed on a track having a recess, to stop an object from passing through the track. The stopping device includes a driving unit, a forcing unit, a first restricting point, a second restricting point, a rotating unit, and a stopping unit. The forcing unit has a pivoting portion pivoted with the driving unit, and a forcing portion. The first restricting point and the second restricting point are aligned in a perpendicular direction, and the forcing portion is located between the first restricting point and the second restricting point. The rotating unit has a rotating axle, and a first end and a second end located at two opposite sides of the rotating axle. The forcing portion of the forcing unit contacts the first end. The stopping unit has a third end and a fourth end. The third end has an opening, through which the second end of the rotating unit passes. In a first state, the forcing portion of the forcing unit contacts the first restricting point, and the fourth end is located in the recess to stop the object.

In an embodiment of the stopping device of the present invention, the pivoting portion is C-shaped.

In an embodiment of the stopping device of the present invention, the second end is arc-shaped.

In an embodiment of the stopping device of the present invention, the driving unit rotates to drive the forcing portion of the forcing unit to move to press against the second restricting point. The forcing portion applies a force on the first end of the rotating unit. The second end of the rotating unit rotates with the rotating axle as an axis to drive the stopping unit to move up in the perpendicular direction. Therefore, the fourth end of the stopping unit departs from the recess, and thus the object passes through the track.

The present invention further provides an MFP, which includes a case and a stopping device. The case has a track, paper is suitable for being conveyed through the track, and the track includes an entrance and a recess adjacent to the entrance. The stopping device is disposed above the track of the case, and includes a driving unit, a forcing unit, a first restricting point, a second restricting point, a rotating unit, and a stopping unit. The forcing unit has a pivoting portion pivoted with the driving unit, and a forcing portion. The first restricting point and the second restricting point are aligned in a perpendicular direction, and the forcing portion is located between the first restricting point and the second restricting point. The rotating unit has a rotating axle, and a first end and a second end located at two opposite sides of the rotating axle. The forcing portion of the forcing unit contacts the first end. The stopping unit has a third end and a fourth end. The third end has an opening, through which the second end of the rotating unit passes. In a first state, the forcing portion of the forcing unit contacts the first restricting point, and the fourth end is located in the recess to stop the object.

In an embodiment of the MFP of the present invention, the pivoting portion is C-shaped.

In an embodiment of the MFP of the present invention, the second end is arc-shaped.

In an embodiment of the MFP of the present invention, the driving unit rotates to drive the forcing portion of the forcing unit to move to press against the second restricting point. The forcing portion applies a force on the first end of the rotating unit. The second end of the rotating unit rotates with the rotating axle as an axis to drive the stopping unit to move up in the perpendicular direction. Therefore, the fourth end of the stopping unit departs from the recess, and thus paper passes through the track.

In view of the above, the stopping unit of the stopping device of the present invention stops or allows the paper to pass through by rotating, so that an MFP using the stopping device can save the space for up and down movement of a rack, as compared with a conventional MFP, thus reducing the overall volume effectively.

In order to make the aforementioned features and advantages of the present invention more comprehensible, embodiments are described in detail with accompanying drawings below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
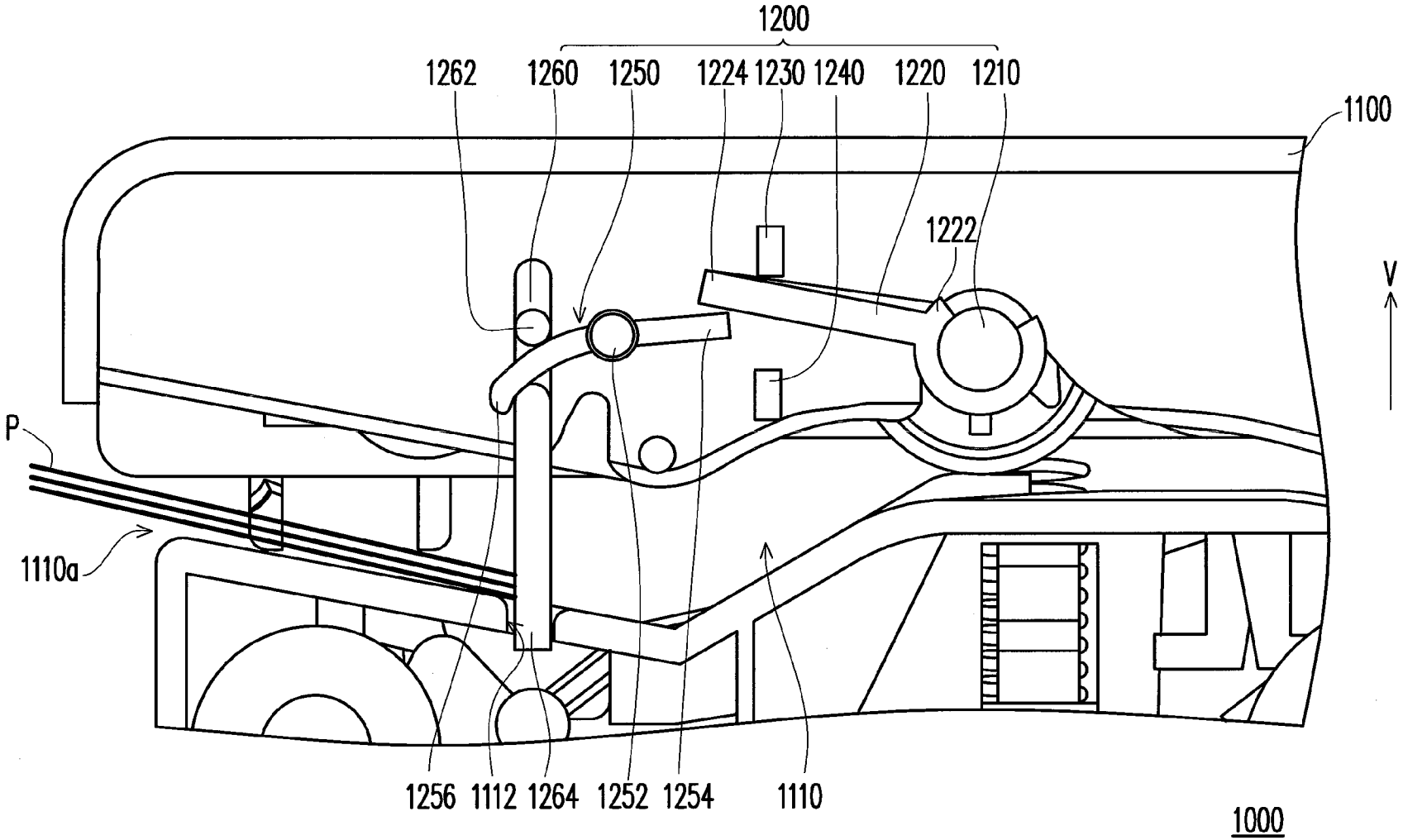
FIG. 1 is a schematic partial sectional view of an MFP according to an embodiment of the present invention.

Reference will now be made in detail to the present embodiments of the invention, examples of which are illustrated in the accompanying drawings. Wherever possible, the same reference numbers are used in the drawings and the description to refer to the same or like parts.

Figure 2:
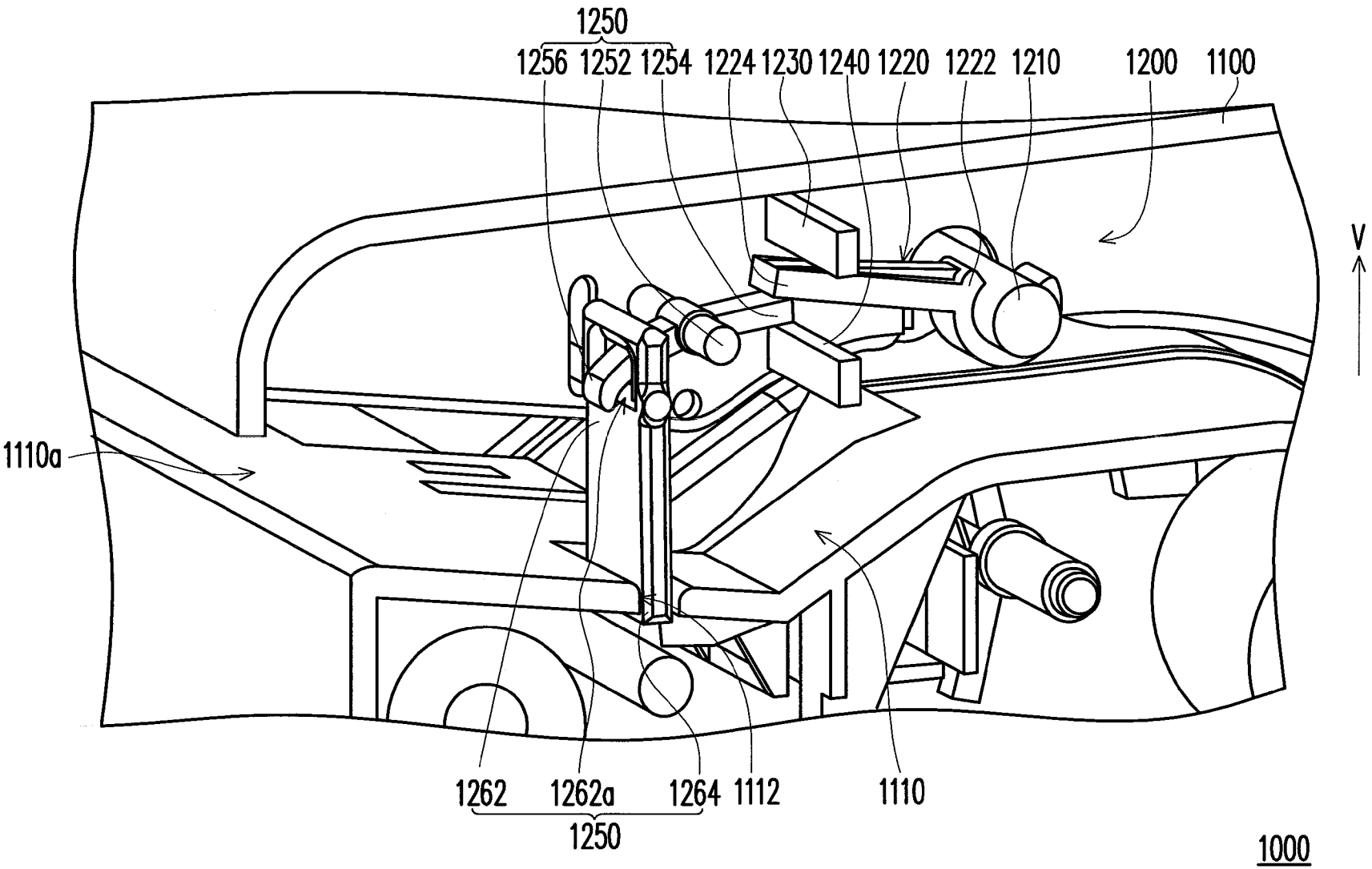
FIG. 2 is a schematic three-dimensional view of the MFP in FIG. 1.

FIG. 1 is a schematic partial sectional view of an MFP according to an embodiment of the present invention, FIG. 2 is a schematic three-dimensional view of the MFP in FIG. 1, and paper P is not shown in FIG. 2. Referring to FIGS. 1 and 2, in this embodiment, an MFP 1000 includes a case 1100 and a stopping device 1200. The case 1100 has a track 1110, and the track has a recess 1112. The stopping device 1200 is disposed in the case 1100, and is located on the track 1110 to stop objects, such as paper P, from passing through the track 1110. The stopping device 1200 includes a driving unit 1210, a forcing unit 1220, a first restricting point 1230, a second restricting point 1240, a rotating unit 1250, and a stopping unit 1260. The forcing unit 1220 has a pivoting portion 1222 pivoted with the driving unit 1210, and a forcing portion 1224. The first restricting point 1230 and the second restricting point 1240 are aligned in a perpendicular direction V in the case 1100. The forcing portion 1224 is located between the first restricting point 1230 and the second restricting point 1240. The rotating unit 1250 has a rotating axle 1252, and a first end 1254 and a second end 1256 located at two opposite sides of the rotating axle 1252. The forcing portion 1224 of the forcing unit 1220 contacts the first end 1254. The stopping unit 1260 has a third end 1262 and a fourth end 1264. The third end 1262 has an opening 1262*a*, through which the second end 1256 of the rotating unit 1250 passes.

In this embodiment, the driving unit 1210 may be a shaft of a paper-fetching roller, and may be driven by a motor. The pivoting portion 1222 is C-shaped, so as to be sleeved on the roller. In other embodiments, the pivoting portion 1222 may also be of a hollow round shape, and is selected according to practical demands.

Referring to FIGS. 1 and 2, in a first state, the stopping device 1200 stops the paper P, so that the paper P cannot enter into the track 1110 of the case 1100 of the MFP 1000 for being conveyed. In this case, the forcing portion 1224 of the forcing unit 1220 contacts the first restricting point 1230, and the fourth end 1264 is located in the recess 1112 to stop the paper. Particularly, the second end 1256 of the rotating unit 1250 is slightly arc-shaped, so that after passing through the opening 1262*a*, the second end 1256 slightly hooks the third end 1262 of the stopping unit 1260. If the shape of second end 1256 cannot interfere with the third end 1262 of the stopping unit 1260, it is very likely that the second end 1256 departs from the opening 1262*a*, and thus the whole stopping device 1200 fails, since the fourth end 1264 of the stopping unit 1260 is fixed in the recess 1112, and acts as a rotating axle of the stopping unit 1260, so that the third end 1262 rotates relative to the fourth end 1264 with the rotating axle as an axis. Therefore, a slight arc-shape of the second end 1256 of the rotating unit 1250 can prevent the second end 1256 from departing from the opening 1262*a*, so as to keep the function completeness of the stopping device 1200.

Figure 3:
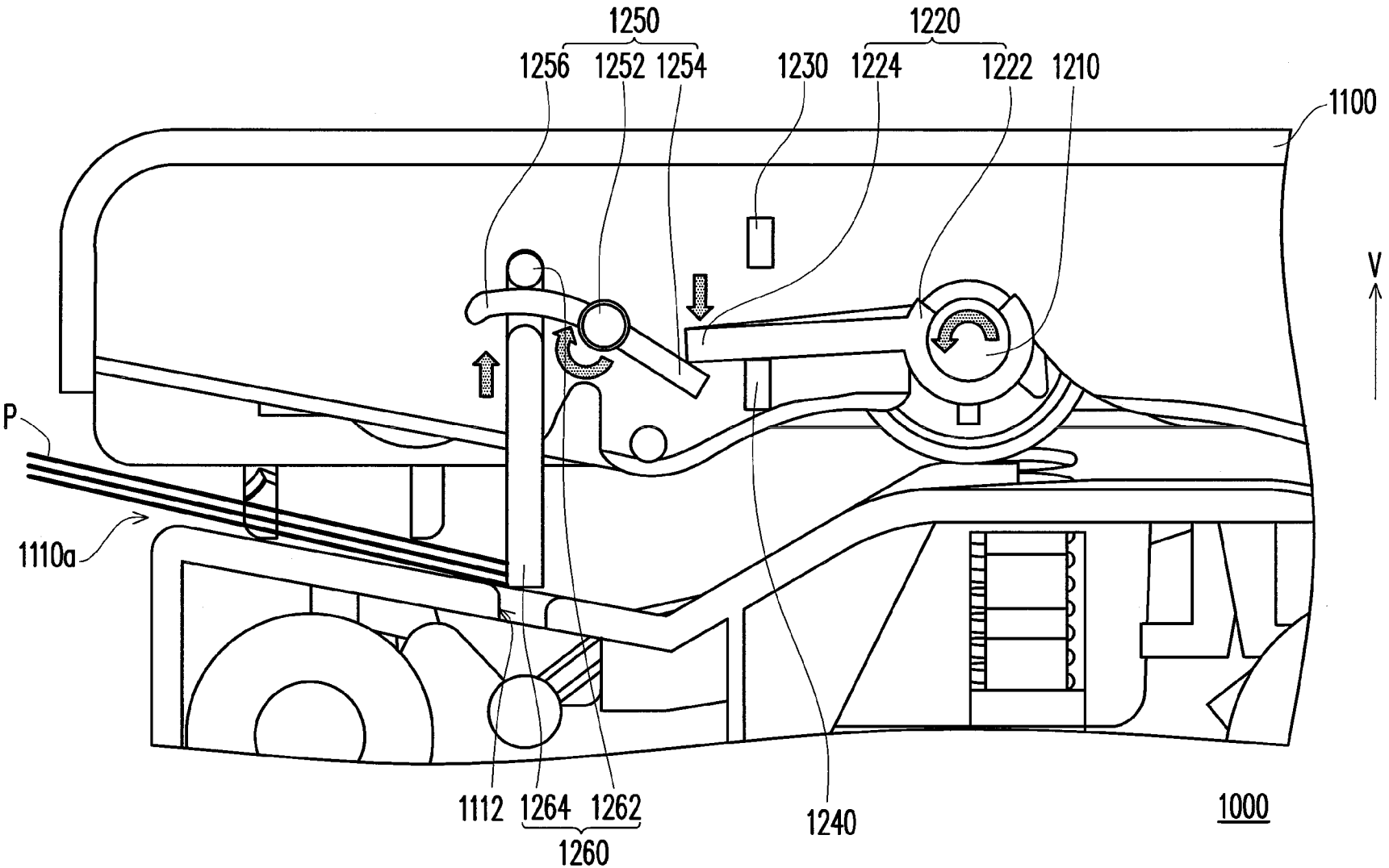
FIGS. 3 and 4 are schematic sectional views of an action process, in which a stopping device stops stopping paper, and the paper is fed into an MFP.
Figure 4:
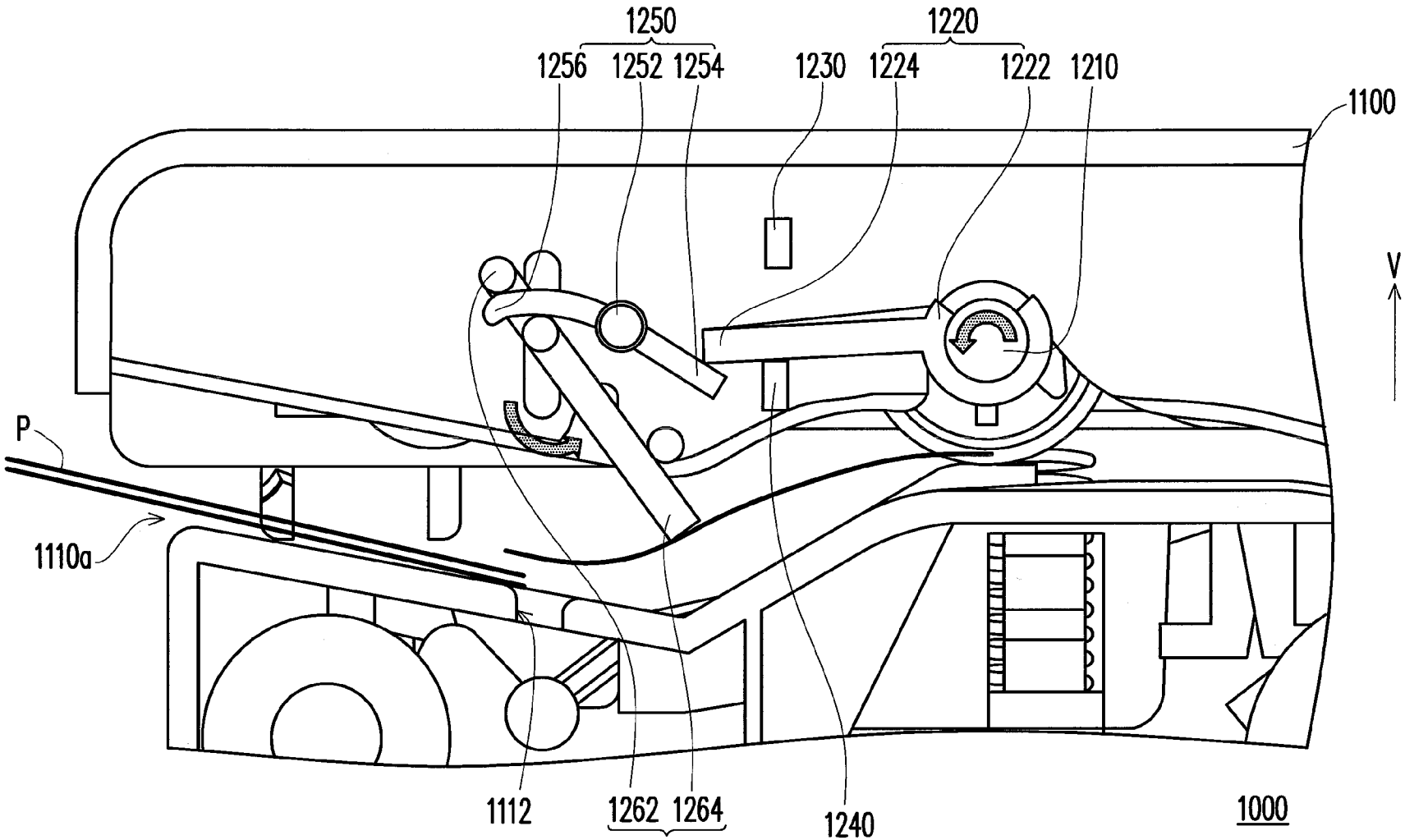

FIGS. 3 and 4 are schematic sectional views of an action process, in which a stopping device stops stopping paper, and the paper is fed into an MFP. As shown in FIG. 3, when the driving unit 1210 rotates (in this embodiment, the driving unit 1210 rotates counterclockwise), the driving unit 1210 drives the pivoting portion 1222 to rotate together, so that the forcing portion 1224 of the forcing unit 1220 moves and leaves the first restricting point 1230. Meanwhile, the forcing portion 1224 of the forcing unit 1220 applies a force on the first end 1254 of the rotating unit 1250, the second end 1256 of the rotating unit 1250 rotates with the rotating axle 1252 as an axis to draw the stopping unit 1260 to move up in the perpendicular direction V, and thus the fourth end 1264 of the stopping unit 1260 departs from the recess 1112. Then, as shown in FIG. 4, when the paper is fed into the track 1110, a front end of the paper P contacts a front edge of the fourth end 1264 facing an entrance 1110*a* of the track 1110, and a force with which the paper P entering into the track 1110 pushes the fourth end 1264 to move. The fourth end 1264 rotates counterclockwise with the third end 1262 hooked by the second end 1256 of the rotating unit 1250 as an axis, so as to allow the paper P to pass continuously and successfully. In addition, the disposition of the second restricting point 1240 can prevent the forcing portion 1224 of the forcing unit 1220 from over rotating along with the rotating axle 1252 with the pivoting portion 1222 as an axis to make the stopping unit 1260 rise too much. In other words, the forcing portion 1224 only moves from the first restricting point 1230 against which the forcing portion 1224 presses to press the second restricting point 1240.

After a feeding process of the paper P is completed, there is no more paper P to push the fourth end 1264 of the stopping unit 1260 to move, and thus the fourth end 1264 naturally droops. In this case, the transmission member 1210 rotates in a reverse direction (clockwise) to drive the forcing portion 1224 of the forcing unit 1220 moves from the second restricting point 1240 up to the first restricting point 1230. With the rotating axle 1252 of the rotating unit 1250 as an axis, the first end 1254 rotates upwards along with the forcing portion 1224, and the second end 1256 rotates downwards, so that the force for lifting the stopping unit 1260 vanishes, the stopping unit 1260 moves downwards, and the fourth end 1264 re-enters into the recess 1112, thus achieving a stopping effect.

In view of the above, in the stopping device and the MFP using the same according to the present invention, the stopping unit of the stopping device is pushed by the paper to rotate to enable the paper to pass through the track. Although the stopping unit moves in the perpendicular direction, the movement range of the stopping unit in the perpendicular direction is small. Therefore, unlike the conventional MFP in which the rack makes the paper stopping plate move in the perpendicular direction, the distance of the movement of the rack in the perpendicular direction is saved, thus effectively reducing the overall volume of the MFP. In addition, when the paper is being fed, the fourth end of the stopping unit is naturally perpendicular to the paper. Therefore, if the paper is stuck, after the case is opened to remove the stuck paper, then the case is closed, and the paper is fed again, the fourth end of the stopping unit is unlikely to tear the paper located in the track.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A stopping device, suitable for being disposed on a track having a recess, to stop an object from passing through the track, comprising:

a driving unit;

a forcing unit, having a pivoting portion pivoted with the driving unit, and a forcing portion;

a first restricting point and a second restricting point, aligned in a perpendicular direction, wherein the forcing portion is located between the first restricting point and the second restricting point;

a rotating unit, having a rotating axle, and a first end and a second end located at two opposite sides of the rotating axle, wherein the forcing portion of the forcing unit contacts the first end; and a stopping unit, having a third end and a fourth end, wherein the third end has an opening, through which the second end of the rotating unit passes; and in a first state, the forcing portion of the forcing unit contacts the first restricting point, and the fourth end is located in the recess to stop the object.

2. The stopping device according to claim 1, wherein the pivoting portion is C-shaped.

3. The stopping device according to claim 1, wherein the second end is arc-shaped.

4. The stopping device according to claim 1, wherein the driving unit rotates to drive the forcing portion of the forcing unit to move to press against the second restricting point, the forcing portion applies a force on the first end of the rotating unit, the second end of the rotating unit rotates with the rotating axle as an axis to drive the stopping unit to move up in the perpendicular direction, the fourth end of the stopping unit departs from the recess, and thus the object passes through the track.

5. A multi-function peripheral (MFP), comprising:

a case, having a track, wherein at least one piece of paper is suitable for being conveyed through the track, and the track comprises an entrance and a recess adjacent to the entrance;

a stopping device, disposed above the track of the case, and comprising:

a driving unit;

a forcing unit, having a pivoting portion pivoted with the driving unit, and a forcing portion;

a first restricting point and a second restricting point, aligned in a perpendicular direction, wherein the forcing portion is located between the first restricting point and the second restricting point;

a rotating unit, having a rotating axle, and a first end and a second end located at two opposite sides of the rotating axle, wherein the forcing portion of the forcing unit contacts the first end; and a stopping unit, comprising a third end and a fourth end, wherein the third end has an opening, through which the second end of the rotating unit passes; and in a first state, the forcing portion of the forcing unit contacts the first restricting point, and the fourth end is located in the recess to stop the object.

6. The MFP according to claim 5, wherein the pivoting portion is C-shaped.

7. The MFP according to claim 5, wherein the second end is arc-shaped.

8. The MFP according to claim 5, wherein the driving unit rotates to drive the forcing portion of the forcing unit to move to press against the second restricting point, the forcing portion applies a force on the first end of the rotating unit, the second end of the rotating unit rotates with the rotating axle as an axis to drive the stopping unit to move up in the perpendicular direction, the fourth end of the stopping unit departs from the recess, and thus the paper passes through the track.

* * * * *